US008613211B2

(12) United States Patent
Fujita et al.

(10) Patent No.: US 8,613,211 B2
(45) Date of Patent: Dec. 24, 2013

(54) SHOT PEENING APPARATUS AND SHOT PEENING METHOD

(75) Inventors: Jun Fujita, Hyogo (JP); Takeshi Yamamoto, Hyogo (JP); Atsushi Kamiyoshi, Hyogo (JP); Mitsuru Handa, Aichi (JP); Yoshihiro Watanabe, Aichi (JP); Kanehisa Hattori, Aichi (JP); Shogo Sasaki, Aichi (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 469 days.

(21) Appl. No.: 12/671,094

(22) PCT Filed: Dec. 11, 2008

(86) PCT No.: PCT/JP2008/072523

§ 371 (c)(1),
(2), (4) Date: Jan. 28, 2010

(87) PCT Pub. No.: WO2009/081749

PCT Pub. Date: Jul. 2, 2009

(65) Prior Publication Data

US 2010/0199736 A1 Aug. 12, 2010

(30) Foreign Application Priority Data

Dec. 20, 2007 (JP) ..... 2007-328486

(51) Int. Cl.
*C21D 7/06* (2006.01)

(52) U.S. Cl.
USPC ..... 72/53; 29/90.7

(58) Field of Classification Search
USPC ..... 72/53; 29/90.7
See application file for complete search history.

(56) References Cited

U.S. PATENT DOCUMENTS 3,491,790 A * 1/1970 Sanford ..... 137/533.11
3,858,359 A * 1/1975 Leliaert ..... 451/88

(Continued)

FOREIGN PATENT DOCUMENTS

CN 101027532 A 8/2007
JP 60-158376 A 8/1985

(Continued)

OTHER PUBLICATIONS

Chinese Office Action dated Apr. 26, 2011, issued in corresponding Chinese Patent Application No. 200880100980.5.

(Continued)

*Primary Examiner* — Dana Ross
*Assistant Examiner* — Homer Boyer
(74) *Attorney, Agent, or Firm* — Westerman, Hattori, Daniels & Adrian, LLP

(57) ABSTRACT

A shot peening apparatus 1 includes: a storage container 2 that stores therein shots B impacting on a shot-peening treated region U; a vibrator 5 that accelerates the shots B; a shot outlet 4 that is formed on the storage container 2, and connected to a shot collecting passage 10 through which the shots B in a container inside 2I are collected, and through which the shots B are taken out from the container inside 2I into the shot collecting passage 10; and a shot inlet 3 that is formed on the storage container 2, and connected to a shot supplying passage 9 through which the shots B are supplied into the container inside 2I, and through which the shots B are supplied into the container inside 2I from the shot supplying passage 9.

5 Claims, 9 Drawing Sheets

(56) References Cited

U.S. PATENT DOCUMENTS

| | | | | | |
|---|---|---|---|---|---|
| 3,877,175 | A * | 4/1975 | Snyder | 451/88 |
| 4,042,808 | A * | 8/1977 | Hennessy et al. | 377/50 |
| 4,744,181 | A * | 5/1988 | Moore et al. | 451/39 |
| 5,415,584 | A * | 5/1995 | Brooke et al. | 451/99 |
| 5,702,289 | A * | 12/1997 | Champaigne | 451/38 |
| 5,797,290 | A * | 8/1998 | Blissell et al. | 72/53 |
| 6,173,736 | B1 * | 1/2001 | Ligh | 137/494 |
| H0001971 | H * | 7/2001 | Joyner et al. | 72/53 |
| 6,343,495 | B1 * | 2/2002 | Cheppe et al. | 72/53 |
| 7,182,671 | B1 * | 2/2007 | Shimizu et al. | 451/8 |
| 7,669,449 | B1 * | 3/2010 | Sundstrom et al. | 72/53 |
| 7,691,211 | B2 * | 4/2010 | Lu et al. | 148/240 |
| 7,735,545 | B2 * | 6/2010 | Chow | 165/95 |
| 2001/0021630 | A1 | 9/2001 | Izawa et al. | |
| 2006/0083641 | A1 * | 4/2006 | Ellens et al. | 417/415 |
| 2009/0301152 | A1 * | 12/2009 | Bayer et al. | 72/53 |

FOREIGN PATENT DOCUMENTS

| | | | |
|---|---|---|---|
| JP | 60-232872 | A | 11/1985 |
| JP | 5-46829 | A | 2/1993 |
| JP | 2001-252872 | * | 9/2001 |
| JP | 2001-252872 | A | 9/2001 |
| JP | 2004-195640 | A | 7/2004 |
| JP | 2006-102908 | A | 4/2006 |
| JP | 2006-346775 | A | 12/2006 |
| JP | 2007-181909 | A | 7/2007 |
| KR | 10-2004-0036121 | A | 4/2004 |
| TW | 516993 | B | 1/2003 |

OTHER PUBLICATIONS

International Search Report of PCT/JP2008/072523, mailing date of Mar. 17, 2009.

Korean Office Action dated May 31, 2012, issued in corresponding Korean Patent Application No. 10-2010-7002005, (10 pages). With English Translation.

Chinese Office Action dated Jun. 6, 2012, issued in corresponding Chinese Patent Application No. 200880100980.5, English translation only (9 pages).

Japanese Office Action dated Aug. 14, 2012, issued in corresponding Japanese Patent Application No. 2007-328486, with English translation (7 pages).

Chinese Office Action dated May 20, 2013, issued in corresponding Chinese Patent Application No. 200880100980.5, w/ English translation.

Japanese Office Action dated Mar. 19, 2013, issued in corresponding Japanese Patent Application No. 2007-328486, w/ English translation.

Korean Notice of Allowance dated Mar. 26, 2013, issued in corresponding Korean Patent Application No. 10-2010-7002005, w/ partial English translation.

Japanese Notice of Allowance dated Oct. 1, 2013, in corresponding Japanese Application No. 2007-328486 with Partial English Translation. (2 pages).

* cited by examiner

SHOT PEENING APPARATUS AND SHOT PEENING METHOD

TECHNICAL FIELD

The present invention relates to shot peening.

BACKGROUND ART

Shot peening is a type of cold working, and makes shots, which are metal or non-metal balls, impact on a metal surface at a high speed to generate a compressive stress on the metal surface to improve fatigue strength thereof against repeated loads. For example, to improve fatigue strength of a welded joint in a pressure vessel of a chemical plant or a reactor vessel, the shot peening is treated thereto. Patent Document 1 discloses an ultrasonic shot peeing apparatus that shot-peens a J-weld between a bottom surface of a reactor vessel head and a nozzle stub, and surfaces near the J-weld.

[Patent Document 1] Japanese Patent Application Laid-open No. 2006-346775 (0015, FIG. 2, FIG. 3)

DISCLOSURE OF INVENTION

Problem to be Solved by the Invention

In the technology disclosed in Patent Document 1, a collection hole is provided on a disk, and a vibrator is arranged thereon to shoot out shots in a direction opposing to the direction that the gravity works. Upon collecting the shots, the vibrator is removed to collect the shots through the collection hole provided on the disk. Therefore, in the technology disclosed in Patent Document 1, it has been difficult to collect the shots when a shot-peening treated region is positioned toward the direction that the gravity works. The present invention is made in consideration of the above, and an object of the present invention is to enable the shots used for shot peening to be collected reliably, regardless of a position or an arrangement of the shot-peening treated region.

Means for Solving Problem

According to an aspect of the present invention, a shot peening apparatus includes: a storage container that stores therein shots impacting on a shot-peening treated region; a shot accelerating unit that accelerates the shots; a shot collecting passage through which the shots inside the storage container are collected from inside the storage container by way of sucking; and a shot outlet that is formed on the storage container and connected to the shot collecting passage, and through which the shots inside the storage container are taken out into the shot collecting passage.

The shot peening apparatus uses the shot collecting passage that is connected to the storage container storing therein the shots to suck and collect the shots inside the storage container. Therefore, the shots completed shot peening can be collected reliably at the shot-peening treated region, regardless of a position or an arrangement of the shot-peening treated region.

According to another aspect of the present invention, a shot peening apparatus includes: a storage container that stores therein shots impacting on a shot-peening treated region; a shot accelerating unit that accelerates the shots; a shot collecting passage through which the shots inside the storage container are collected from inside the storage container by way of sucking; a shot outlet that is formed on the storage container and connected to the shot collecting passage, and through which the shots inside the storage container are taken out into the shot collecting passage; a shot supplying passage through which the shots are supplied to inside the storage container; and a shot inlet that is formed on the storage container and connected to the shot supplying passage, and through which the shots are supplied to inside the storage container from the shot supplying passage.

The shot peening apparatus uses the shot collecting passage connected to the storage container storing therein the shots to suck and collect the shots inside the storage container. Therefore, the shots completed shot peening can be collected reliably at the shot-peening treated region, regardless of a position or an arrangement of the shot-peening treated region. Furthermore, because the shot peening apparatus includes the shot supplying passage through which the shots are supplied to inside the storage container, the shots can be supplied to inside the storage container after moving the shot peening apparatus to the treated region. In this manner, the shots can be prevented from leaking out of the inside of the storage container while moving the shot peening apparatus to the treated region.

Advantageously, the shot peening apparatus further includes a shot outlet opening and closing unit that opens and closes the shot outlet. Therefore, the shots can be prevented from leaking out of the storage container while performing shot peening. In this manner, the shot peening can be performed reliably.

Advantageously, the shot peening apparatus further includes a shot inlet opening and closing unit that opens and closes the shot inlet. Therefore, the shots can be prevented from leaking out of the storage container while performing shot peening. In this manner, the shot peening can be performed reliably.

Advantageously, in the shot peening apparatus, the shot inlet is blocked with a blocking object that blocks the shot inlet, while shot peening is being performed, and the shot inlet is formed to have a smaller cross section on an inner side of the storage container than on an outer side of the storage container, and the shot inlet on the inner side of the storage container allows the shots, but not the blocking object, to pass therethrough. In this manner, the shot inlet can be blocked by a simple technique.

Advantageously, the shot peening apparatus further includes a shot counting unit that is arranged at the shot inlet and counts number of the shots to be supplied to inside the storage container. In this manner, the number of the shots to be supplied into the storage container can be counted. Thus, shot peening can be managed more conveniently.

According to still another aspect of the present invention, a method of shot peening comprising: moving a shot peening apparatus to a shot-peening treated region, the shot peening apparatus including a storage container that stores therein shots impacting on the shot-peening treated region and a shot collecting passage that is connected to the storage container and through which the shots are collected by sucking the shots from inside the storage container; shot peening; collecting the shots by sucking the shots from inside the storage container through the shot collecting passage at the treated region, after the step of shot peening is completed; and moving the shot peening apparatus away from the treated region. In this manner, the shots completed shot peening can be collected reliably at the shot-peening treated region, regardless of a position or an arrangement of the shot-peening treated region.

According to still another aspect of the present invention, a method of shot peening includes: moving a shot peening apparatus to a shot-peening treated region, the shot peening apparatus including a storage container that stores therein shots impacting on the shot-peening treated region, a shot collecting passage that is connected to the storage container and through which the shots are collected by sucking the shots from inside the storage container, and a shot supplying passage that is connected to the storage container and through which the shots are supplied to inside the storage container; and supplying the shots for use in shot peening from the shot supplying passage to inside the storage container; shot peening; collecting the shots by sucking the shots from inside the storage container through the shot collecting passage at the treated region, after the step of shot peening is completed; and moving the shot peening apparatus away from the treated region. In this manner, the shots completed shot peening can be collected reliably at the shot-peening treated region, regardless of a position or an arrangement of the shot-peening treated region.

Effect of the Invention

The present invention allows shots for use in shot peening to be collected reliably, regardless of a position or an arrangement of a shot-peening treated region.

EXPLANATIONS OF LETTERS OR NUMERALS

Figure 1:
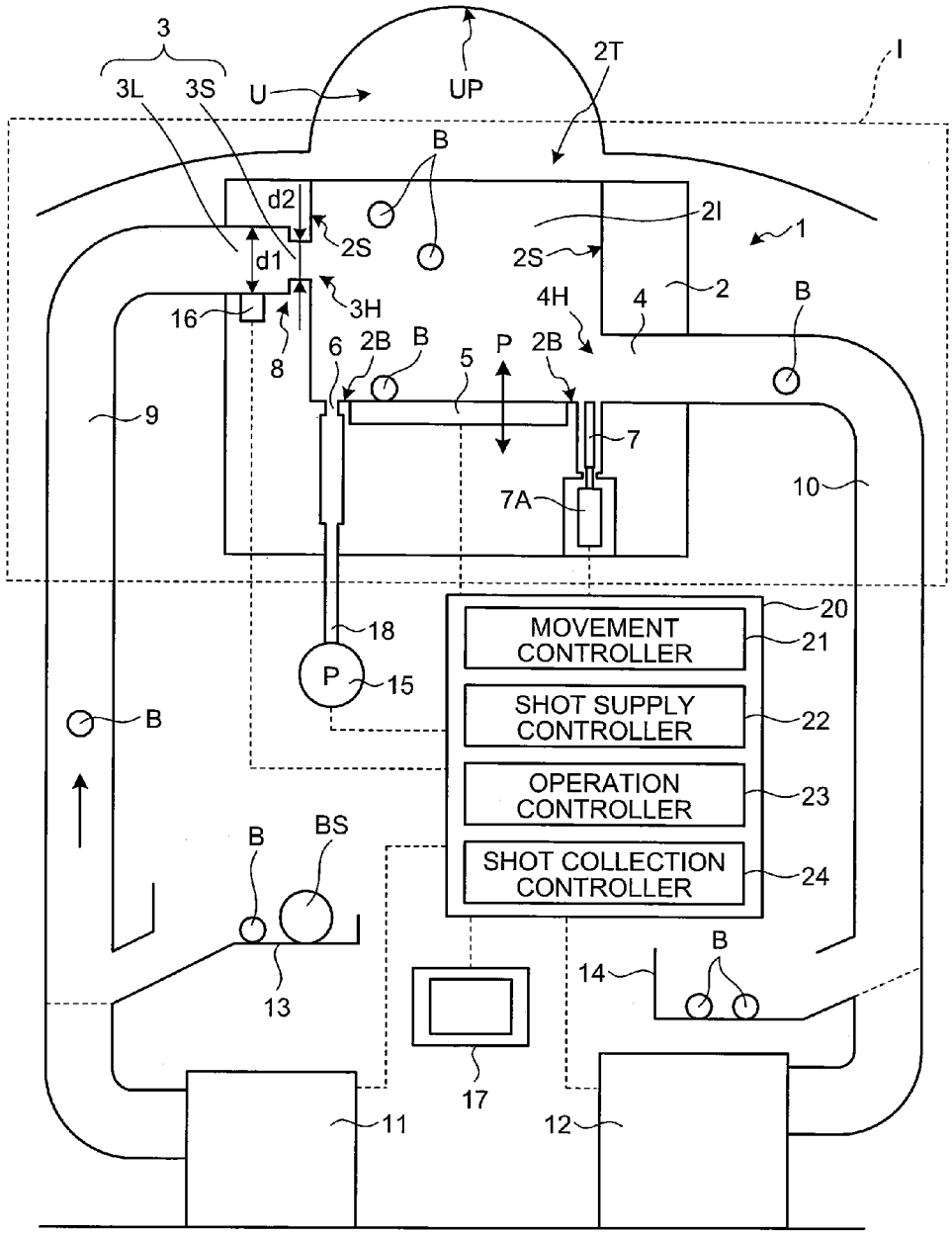
FIG. 1 is a schematic of an entire structure of a shot peening apparatus according to an embodiment of the present invention.

1, 1*a* shot peening apparatus
2 storage container
2I container inside
3 shot inlet
3H shot inlet in-container opening
3L outer-side inlet passage
3S inner-side inlet passage
4 shot outlet
4H shot outlet in-container opening
5 vibrator
6 gas injecting nozzle
7 shot outlet shutter
8 connection
9 shot supplying passage
10 shot collecting passage
11 blower
12 suctioning unit
15 pump
16 shot counter
20 shot peening controlling unit
21 movement controlling unit
22 shot supply controlling unit
23 operation controlling unit
24 shot collection controlling unit
30 electrical discharge machine
31 metallic structure
32 manipulator
B shots
BS blocking object

BEST MODE(S) FOR CARRYING OUT THE INVENTION

The present invention will now be explained in details with reference to the attached drawings. The embodiments explained hereinafter are not intended to limit the scope of the present invention in any way. Structural elements disclosed hereinafter include those that can be easily imagined by those in the art, those that are substantially the same, and those in the scope of so-called equivalent.

First Embodiment

The present invention is suitable for shot-peening a surface having a concave or a convex portion. The present invention is not limited to shot peening of a weld. Moreover, the present invention can be generally applied to anything that requires shot peening, such as an internal or an external surface of a nozzle stub located at an inlet or an outlet of a steam generator, a pipe for a fluid, or a pressure vessel used in a power generating facility; and applications of the present invention is not especially limited as well. The present invention is especially effective for performing shot peening in a closed space.

One of the features of the embodiment is that the shots used for shot peening are collected from the shot peening apparatus by way of sucking at a treated region, and then the shot peening apparatus is moved away from the treated region. A structure of a shot peening apparatus according to the embodiment will now be explained.

Figure 2A:
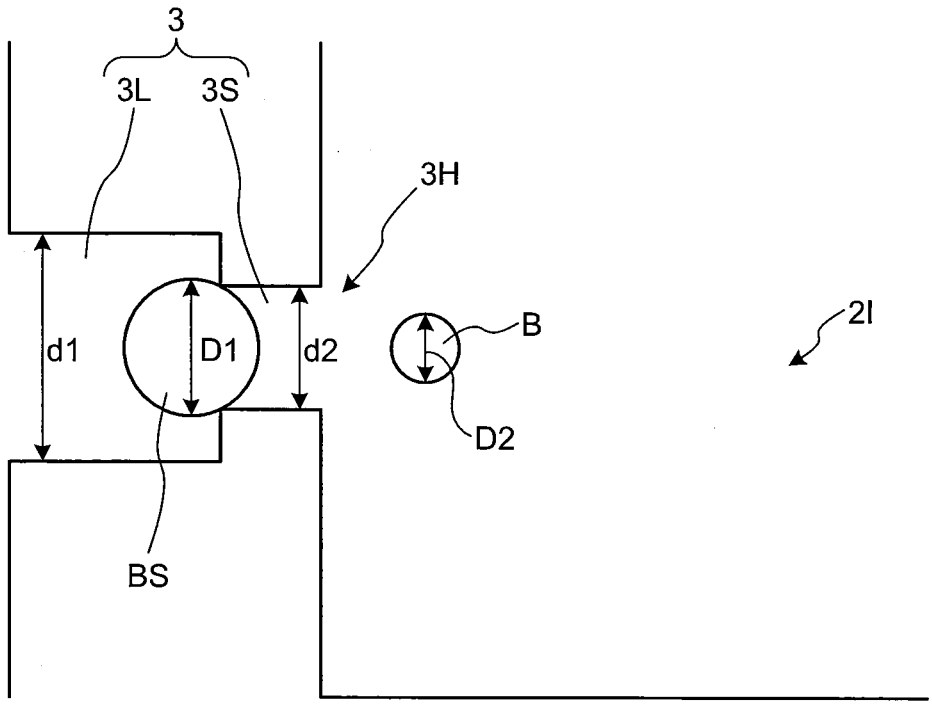
FIG. 2A is an enlarged view of a shot inlet formed on the shot peening apparatus shown in FIG. 1.
Figure 2B:
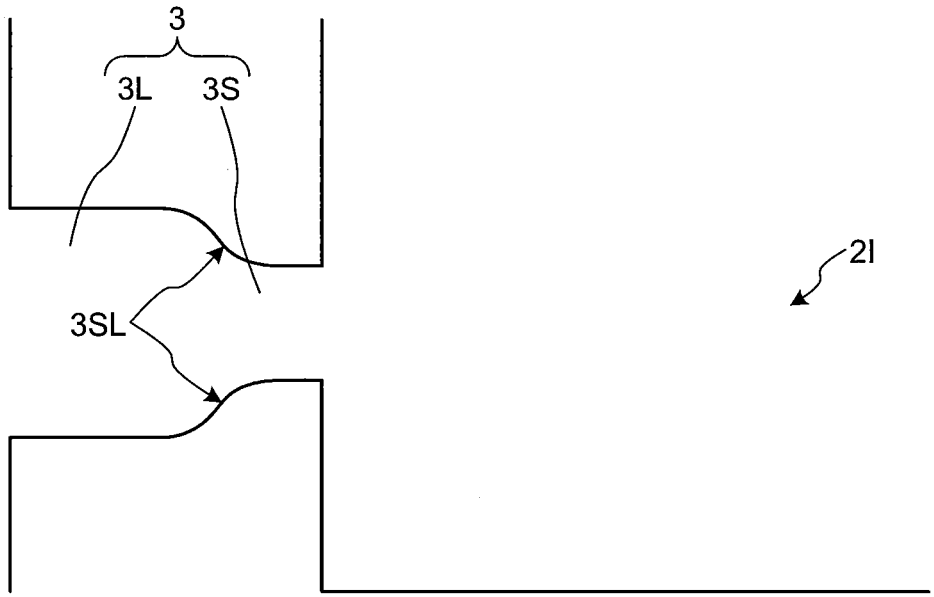
FIG. 2B is an enlarged view of another example of a structure of the shot inlet formed on the shot peening apparatus shown in FIG. 1.
Figure 2C:
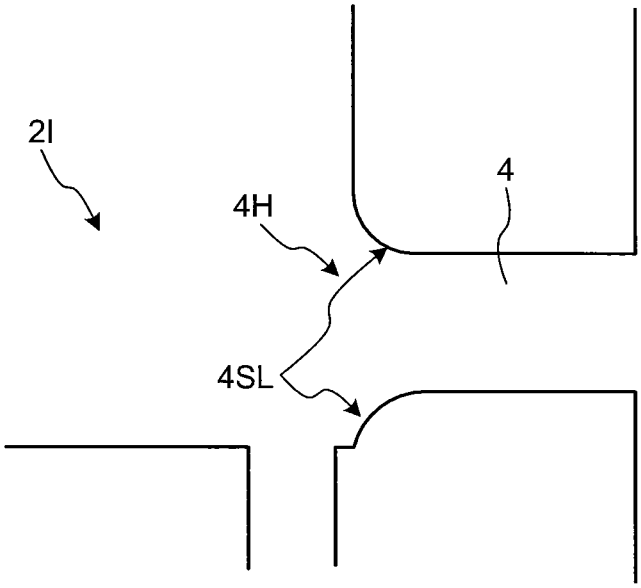
FIG. 2C is an enlarged view of another example of a structure of a shot outlet formed on the shot peening apparatus shown in FIG. 1.

FIG. 1 is a schematic of an entire structure of a shot peening apparatus according to an embodiment of the present invention. FIG. 2A is an enlarged view of a shot inlet formed on the shot peening apparatus shown in FIG. 1. FIG. 2B is an enlarged view of another example of a structure of the shot inlet formed on the shot peening apparatus shown in FIG. 1. FIG. 2C is an enlarged view of another example of a structure of a shot outlet formed on the shot peening apparatus shown in FIG. 1. A shot peening apparatus 1 according to the embodiment includes a storage container 2 that stores therein shots B for use in shot peening. The storage container 2 is moved to a treated region U that is to be treated with shot peening to shot-peen a surface UP on the shot-peening treated region U (a treated region surface).

The storage container 2 is a container with a bottom, and includes a container opening 2T having an opening that faces to the treated region U. A part to which the container opening 2T of the storage container 2 faces is a bottom 2B of the storage container 2. A space surrounded by the bottom 2B of the storage container 2 and an inner side wall 2S of the storage container 2 is an inside (container inside) 2I of the storage container 2, and stores therein the shots B for use in shot peening. Steel balls, non-ferrous metal balls, and nonmetallic balls such as ceramic balls are used as the shots B, and an appropriate type of the shots B is used depending on a material or a usage condition of the treated region U. Upon performing shot peening, the distance between the treated region U and the container opening 2T of the storage container 2 is set so that the shots B do not leak out between the treated region U and the storage container 2.

On the bottom 2B, a vibrator 5 is arranged as a shot accelerating unit that accelerates the shots B and applies thereto an energy required for shot peening. The vibrator 5 includes a vibrating unit having a piezoelectric element such as a piezoelectric element, and a vibrating instrument for communicating vibrations from the vibrator 5 to the shots B. The vibrating unit in the vibrator 5 is driven at a predetermined frequency (e.g., a frequency in the ultrasonic range) to vibrate the part that is in contact with the shots B (the vibrating instrument) in the direction from the vibrator 5 toward the container opening 2T (the direction shown by an arrow P in FIG. 1), and to accelerate the shots B toward the container opening 2T.

The shots B are then shot out toward the container opening 2T and onto the treated region surface UP of the treated region U, to apply a compressive stress to the treated region surface UP. In this manner, the shot peening apparatus 1 shot-peens the treated region U by way of ultrasonic shot peening. However, in the present embodiment, the shot peening is not limited to ultrasonic shot peening.

A gas injecting nozzle 6 that is a gas injecting unit is arranged on the bottom 2B of the container inside 2I. The gas injecting nozzle 6 is connected to a pump 15 that is a gas supplying unit through a gas supplying passage 18. During shot peening, the pump 15 supplies pressurized gas (in this embodiment, air) to the gas injecting nozzle 6, and the gas is injected from the gas injecting nozzle 6 to the container inside 2I. Because the shots B in the container inside 2I is dispersed by the gas that is injected out from the gas injecting nozzle 6, the shots B are brought in contact with the vibrator 5 reliably to be accelerated thereby. As a result, a lack of shot peening can be suppressed. Instead of the pump 15, a tank filled with compressed gas may be connected to the gas supplying passage 18, and the gas may be injected out from the gas injecting nozzle 6 into the container inside 2I.

In the present embodiment, the shot peening apparatus 1 is moved to the treated region U, and the shots B are supplied into the container inside 2I, before performing shot peening. After completing the shot peening, the shots B are collected from the container inside 2I, and then the shot peening apparatus 1 is moved away from the treated region U. To achieve this goal, the storage container 2 includes a shot inlet 3 having a container opening (a shot inlet in-container opening) 3H on the inner side wall 25 in the container inside 2I; and a shot outlet 4 also having a container opening (a shot outlet in-container opening) 4H on the inner side wall 2S in the container inside 2I.

The shots B that have passed through the shot inlet 3 are supplied into the container inside 2I through the shot inlet in-container opening 3H. A shot supplying passage 9 made of a flexible material is connected to the shot inlet 3. The shots B that have passed through the shot supplying passage 9 pass through the shot inlet 3 and the shot inlet in-container opening 3H, and are supplied into the container inside 2I. The shot supplying passage 9 includes a shot feeding unit 13 that feeds the shots B, to be supplied into the container inside 2I, into the shot supplying passage 9. The shot supplying passage 9 is connected to a blower 11 that is a shot conveying unit. The shots B fed into the shot supplying passage 9 by way of the shot feeding unit 13 are conveyed to the container inside 2I by way of the pressure of gas sent by the blower 11.

A shot counter 16 that is a shot counting unit is arranged at the shot inlet 3 to count the number of the shots B to be supplied into the container inside 2I. By way of the shot counter 16, the number of the shots B that have been supplied into the container inside 2I can be recognized. The shot counter 16 includes, for example, a photoelectronic sensor or a magnetic sensor, and detects a change in a photoelectric current or in a magnetic field caused by the shots B passing the position of the shot counter 16. This information is processed by a shot peening controller 20, which will be described later, to count the number of the shots B to be supplied into the container inside 2I.

The shot counter 16 may be arranged at any position between the shot feeding unit 13 and the shot inlet 3; however, if the shots B get stuck in the shot supplying passage 9, the number of the shots B in the container inside 2I may be different from the number of the shots B sent out of the shot feeding unit 13. Therefore, by arranging the shot counter 16 at the shot inlet 3, as disclosed in the present embodiment, the shot counter 16 can correctly count the number of the shots B supplied into the container inside 2I.

As shown in FIGS. 1 and 2B, the shot inlet 3 includes a passage (inner-side inlet passage) 3S at the inner side of the storage container 2 that is positioned closer to the container inside 2I, and a passage (outer-side inlet passage) 3L that is positioned closer to the outside of the storage container 2. The shot inlet 3 is formed so that the inner side thereof toward the storage container 2, that is, on the container inside 2I, has a smaller cross sectional area than that of the outer side of the storage container 2. In the present embodiment, to realize such a form, the inner-side inlet passage 3S and the outer-side inlet passage 3L have a circular cross section, and a diameter d2 of the inner-side inlet passage 3S is set smaller than a diameter d1 of the outer-side inlet passage 3L (d1>d2).

Because a diameter D2 of the shot B for use in shot peening is smaller than the diameter d2 of the inner-side inlet passage 3S (D2>d2), the shots B pass through the inner-side inlet passage 3S, and are supplied into the container inside 2I. In the present embodiment, the shot inlet 3 is closed while shot peening is being performed to prevent the shots B from leaking out of the storage container 2 through the shot inlet 3. Therefore, in the present embodiment, the shot inlet 3 is closed by way of a blocking object BS. As shown in FIG. 2A, a diameter D1 of the blocking object BS is larger than the diameter d2 of the inner-side inlet passage 3S. After a specified number of the shots B are supplied into the container inside 2I, the blocking object BS is sent into the shot inlet 3. Because the blocking object BS cannot pass through the inner-side inlet passage 3S, the blocking object BS becomes locked at a connection 8 between the inner-side inlet passage 3S and the outer-side inlet passage 3L. In this manner, the shot inlet 3 can be closed easily and reliably. In the present embodiment, the blocking object BS is pressed from the side of the shot supplying passage 9 to prevent the blocking object BS from falling off from the shot inlet 3. Alternatively, the shot inlet 3 may be closed by way of a shot outlet opening and closing unit (e.g., a shutter) that opens and closes the shot inlet 3 (more specifically, the shot inlet in-container opening 3H), instead of the blocking object BS. For example, the shot outlet opening and closing unit may be structured as a shot outlet shutter 7 shown in FIG. 1.

As shown in FIG. 2B, a passage cross sectional area gradually changing section 3SL may be provided between the inner-side inlet passage 3S and the outer-side inlet passage 3L, to gradually make the cross sectional area of the passage (that is, the inner diameter of the passage) smaller. Because, by way of such a structure, the inner-side inlet passage 3S and the outer-side inlet passage 3L are connected smoothly, the resistance generated by the shots B upon moving from the outer-side inlet passage 3L to the inner-side inlet passage 3S can be reduced. As a result, the shots B can be supplied into the container inside 2I reliably. The blocking object BS can be removed from the shot inlet 3 by releasing the pressure applied from the side of the shot supplying passage 9, although the blocking object BS is kept in contact with the passage cross sectional area gradually changing section 3SL while the shot inlet 3 is being blocked.

After completing shot peening, the shots B remaining in the container inside 2I are removed from the storage container 2 through the shot outlet in-container opening 4H through the shot outlet 4. A shot collecting passage 10 made of a flexible material is connected to the shot outlet 4. The shots B that have passed through the shot outlet in-container opening 4H and the shot outlet 4 go through the shot collecting passage 10, and collected into a shot tray 14 attached to the shot collecting passage 10. The shot collecting passage 10 is connected to a suctioning unit 12 that is a shot collecting unit. The shots B are sucked out from the container inside 2I into the shot collecting passage 10, by bringing down the pressure in the shot collecting passage 10 lower than that in the container inside 2I by way of the suctioning unit 12. The shots B sucked into the shot collecting passage 10 are collected into the shot tray 14.

As shown in FIG. 2C, a passage cross sectional area gradually changing section 4SL may be provided to the shot outlet 4 to gradually make the cross sectional area of the passage (that is, the inner diameter of the passage) smaller from the shot outlet in-container opening 4H on the container inside 2I. Because such a structure reduces the resistance generated by the shots B upon passing through the shot outlet 4, the shots B can be collected from the container inside 2I reliably.

Upon collecting the shots B from the container inside 2I to the outside, the gas injecting nozzle 6 injects gas into the container inside 2I to disperse the shots B in the container inside 2I. The shots B being away from the shot outlet in-container opening 4H are difficult to be sucked into the shot outlet 4 through the shot outlet in-container opening 4H; however, by allowing the gas injecting nozzle 6 to inject gas into the container inside 2I, the shots B in the container inside 2I can be brought near the shot outlet 4. As a result, the shots B can be collected rapidly to the outside of the container inside 2I.

The shot peening apparatus 1 includes the shot outlet shutter 7 that is the shot outlet opening and closing unit for opening and closing the shot outlet 4 (more specifically, the shot outlet in-container opening 4H). The shot outlet shutter 7 is kept in the bottom 2B of the storage container 2. The shot outlet shutter 7 is caused to operate by way of a shot outlet shutter driving actuator 7A to open and close the shot outlet 4. An air cylinder, for example, is used as the shot outlet shutter driving actuator 7A. While the shot peening is being performed, the shot outlet shutter driving actuator 7A causes the shot outlet shutter 7 to be taken out from the bottom 2B to close the shot outlet 4. In this manner, the shots B are prevented from coming out of the container inside 2I through the shot outlet 4. By way of such a structure, a lack of shot peening can be avoided.

A shot peening controller 20 controls the shot peening apparatus 1. The shot peening controller 20 includes a movement controlling unit 21, a shot supply controlling unit 22, an operation controlling unit 23, and a shot collection controlling unit 24. The shot peening controller 20 is connected to the vibrator 5, the blower 11, the suctioning unit 12, the pump 15, and the shot outlet shutter driving actuator 7A included in shot peening apparatus 1 and controlled by the shot peening controller 20. The shot peening controller 20 is also connected to the shot counter 16, and the shot peening controller 20 obtains the information related to the number of the shots B counted by the shot counter 16.

In the present embodiment, the shot peening controller 20 is connected to a display unit 17. The display unit 17 displays information required by an operator of the shot peening apparatus 1. Such information includes, for example, the number of the shots B to be supplied into the container inside 2I, or opening or closing of the shot outlet shutter 7. In this manner, the operator can understand the status of the shot peening apparatus 1.

The movement controlling unit 21 included in the shot peening controller 20 controls to move the shot peening apparatus 1 to the treated region, and to move the shot peening apparatus 1 away from the treated region. The shot supply controlling unit 22 controls to supply the shots B into the container inside 2I of the shot peening apparatus 1. The operation controlling unit 23 controls to cause the shot peening apparatus 1 moved to the treated region to perform shot peening. The shot collection controlling unit 24 controls to collect the shots B from the container inside 2I after shot peening is completed.

The shot peening apparatus 1 is used in a sealed space such as a water chamber of a reactor to shot-peen a weld between a coolant pipe and a nozzle stub, for example. In such a situation, the part shown as I in FIG. 1 is brought into the sealed space to perform shot peening. In other words, the storage container 2, a part of the shot supplying passage 9 connected thereto, and a part of the shot collecting passage 10 each of which is included in the shot peening apparatus 1 is brought inside the sealed space.

Figure 3:
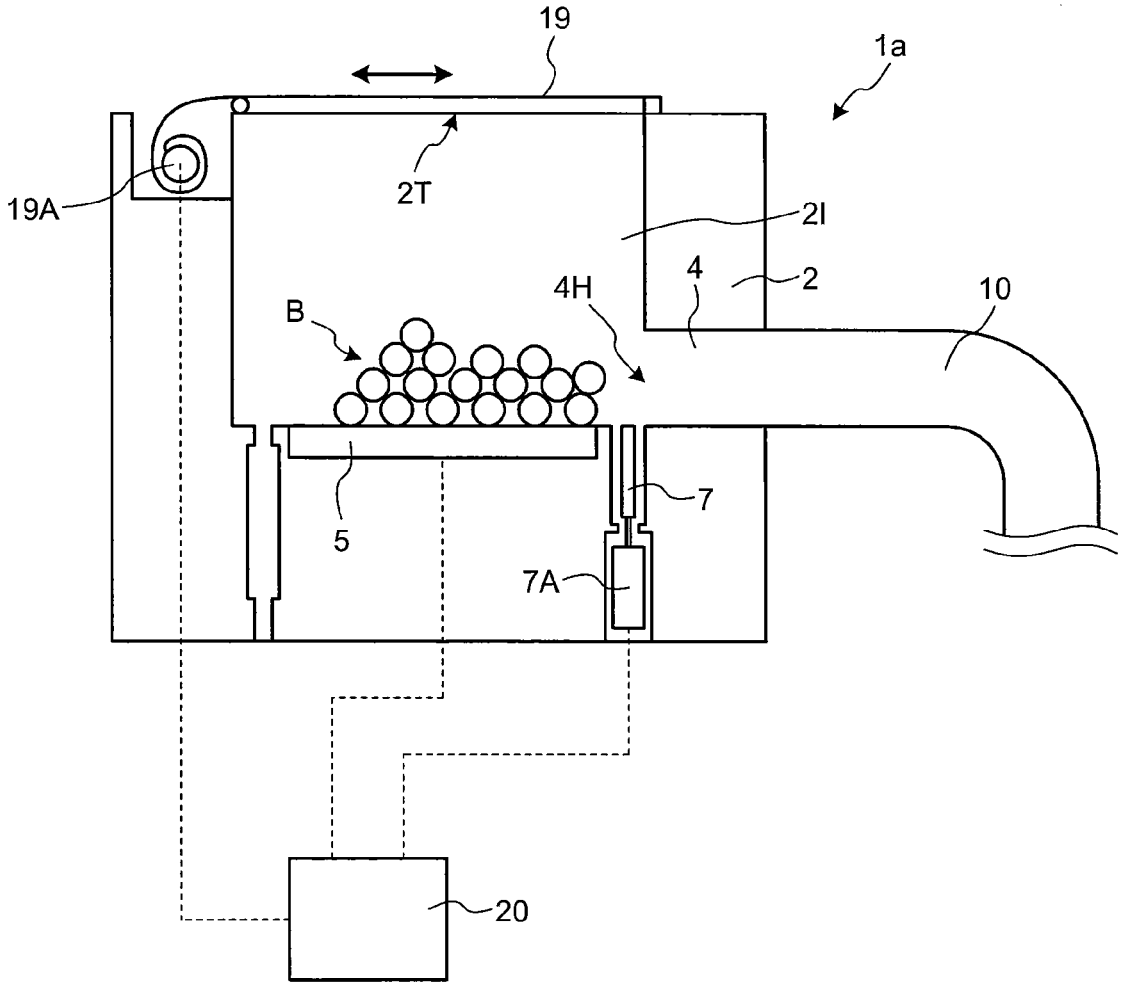
FIG. 3 is a schematic of an entire structure of a shot peening apparatus according to a modification of the embodiment.

FIG. 3 is a schematic of an entire structure of a shot peening apparatus according to a modification of the present embodiment. A shot peening apparatus 1*a* according to this modification has almost the same structure as the shot peening apparatus 1, but is different in that the shot peening apparatus 1*a* includes only the shot outlet 4 and the shot collecting passage 10, and further includes a container opening shutter 19 at the container opening 2T of the storage container 2. The container opening shutter 19 is a container sealing unit that can be opened and closed. The other structure is the same as that of the shot peening apparatus 1.

The shot peening apparatus 1*a* according to this modification includes the container opening shutter 19 at the container opening of the storage container 2. A shutter winding unit 19A winds and unwinds the container opening shutter 19. The shutter winding unit 19A unwinds the container opening shutter 19 to close the container opening 2T; and the container opening shutter 19 winds the shutter winding unit 19A to open the container opening 2T.

Upon performing shot peening, the container opening shutter 19 is opened to open the container opening 2T, and a specified number of the shots B are supplied into the container inside 2I. The container opening shutter 19 is then closed, and the shot peening apparatus 1*a* is moved to the treated region. The container opening shutter 19 is opened at the treated region, and the shot peening controller 20 drives the vibrator 5 to shot-peen the treated region. After completing the shot peening, the shot peening controller 20 causes the shot outlet shutter driving actuator 7A to drive the shot outlet shutter 7 to open the shot outlet in-container opening 4H of the shot outlet 4. At the treated region, the shots B are collected from the container inside 2I through the shot outlet 4 and the shot collecting passage 10. If the number of the collected shot B matches the number of the shots B supplied into the container inside 2I, the shot peening apparatus 1*a* is moved away from the treated region.

In this modification, because the shots B are collected at the treated region, the shots B can be prevented from being lost, and can be collected reliably. As described in this modification, the shot peening apparatus 1*a* at least needs to include a function for collecting the shots B from the container inside 2I. A shot peening process performed by using the shot peening apparatus 1 shown in FIG. 1 will now be explained.

Figure 4:
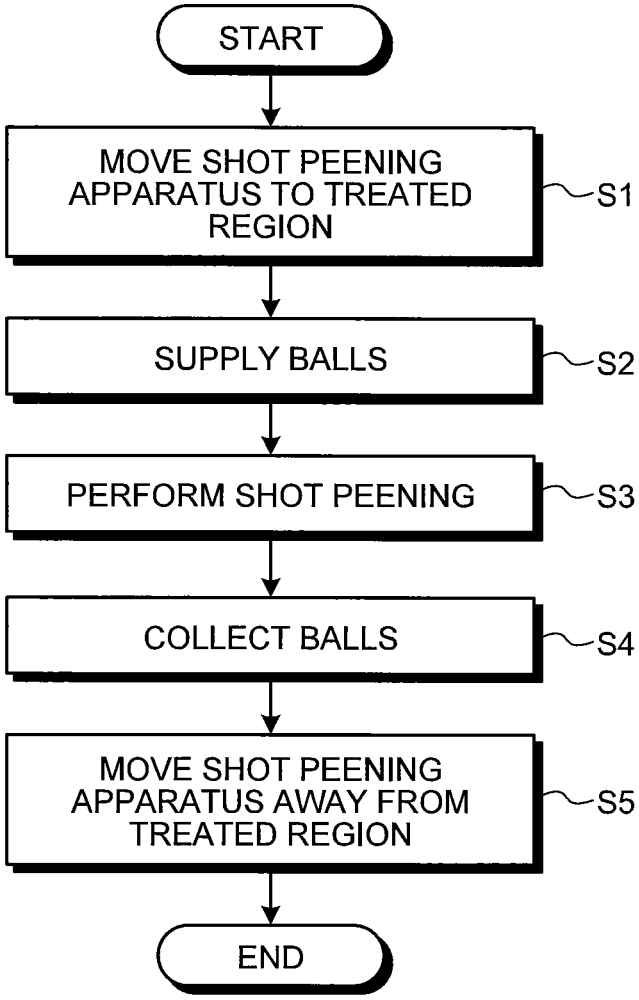
FIG. 4 is a flowchart of steps of shot peening performed by using the shot peening apparatus according to the embodiment.
Figure 5A:
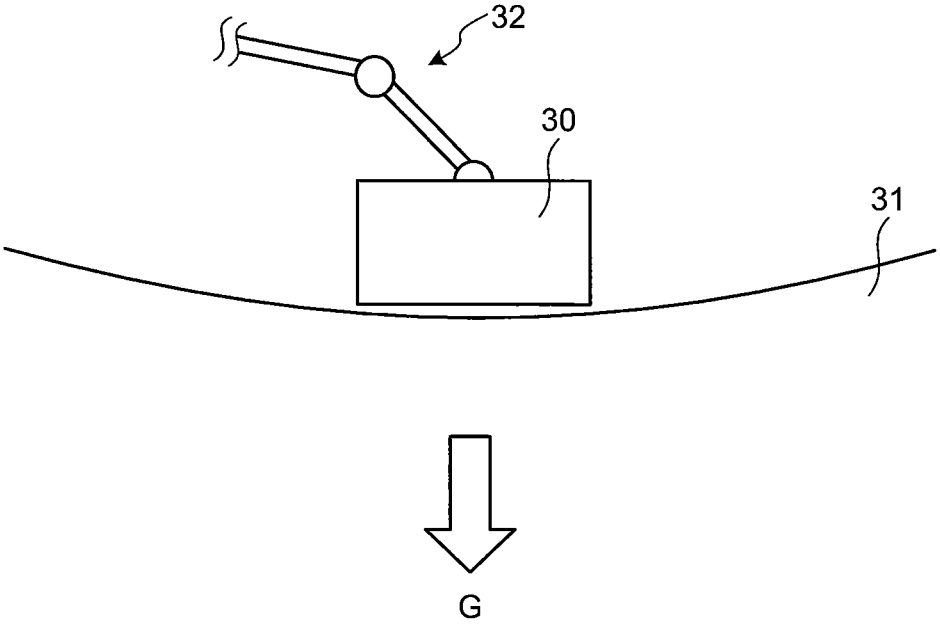
FIG. 5A is an illustrative schematic of a method of shot peening performed by using the shot peening apparatus according to the embodiment.

FIG. 4 is a flowchart of steps of shot peening performed using the shot peening apparatus according to the embodiment. FIGS. 5A to 5H are illustrative schematics of a method of shot peening performed by using the shot peening apparatus according to the present embodiment. Before performing shot peening by using the shot peening apparatus 1 shown in FIG. 1, a predetermined area is removed from the surface of a metallic structure 31 using an electrical discharge machine 30 attached to the tip of a manipulator 32 as shown in FIG. 5A, for example. In FIG. 5A, the direction shown by an arrow G is the direction that the gravity works. The metallic structure 31 is, for example, a joint, connected by way of welding, between the nozzle stub and the coolant pipe in the water chamber of a reactor.

Figure 5B:
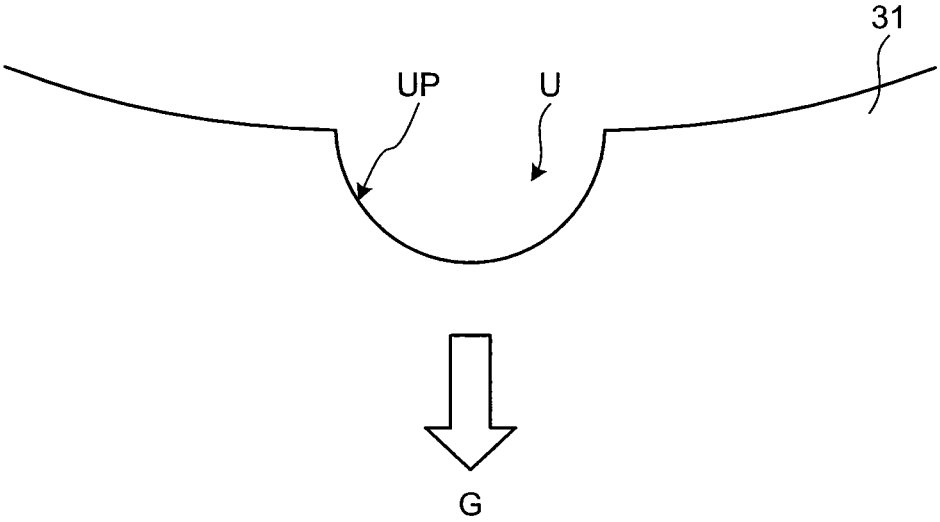
FIG. 5B is another illustrative schematic of the method of shot peening performed by using the shot peening apparatus according to the embodiment.

After removing the predetermined area from the surface of the metallic structure 31, a concave is formed on the surface of the metallic structure 31 as shown in FIG. 5B. To improve fatigue strength, a compressive stress needs to be applied to the surface of the concave by way of shot peening. The concave shown in FIG. 5B is the shot-peening treated region U, and the surface of this concave is the treated region surface UP.

Figure 5C:
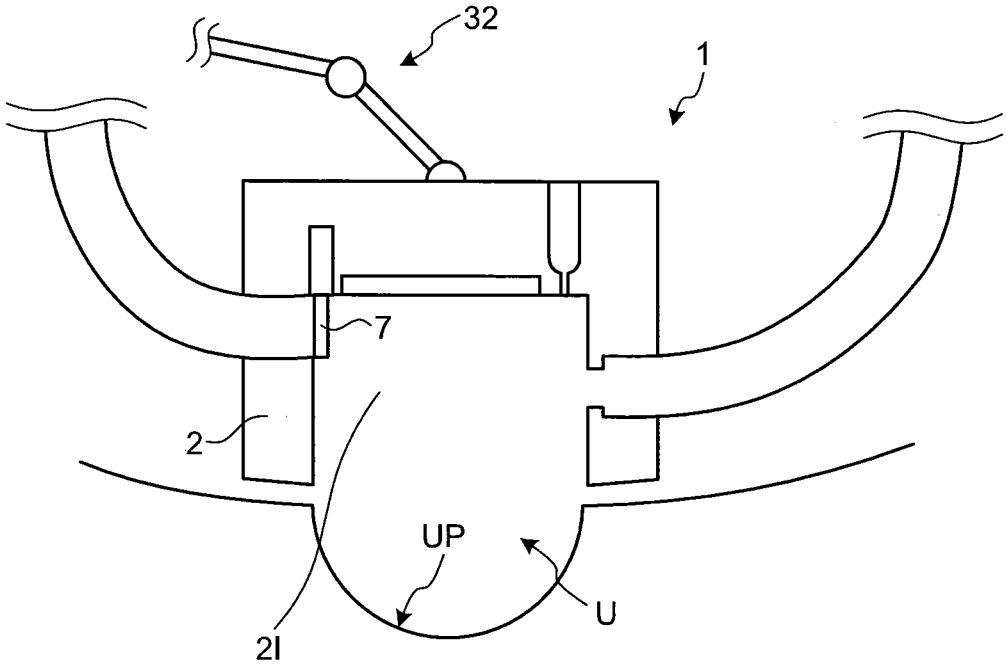
FIG. 5C is another illustrative schematic of the method of shot peening performed by using the shot peening apparatus according to the embodiment.
Figure 5D:
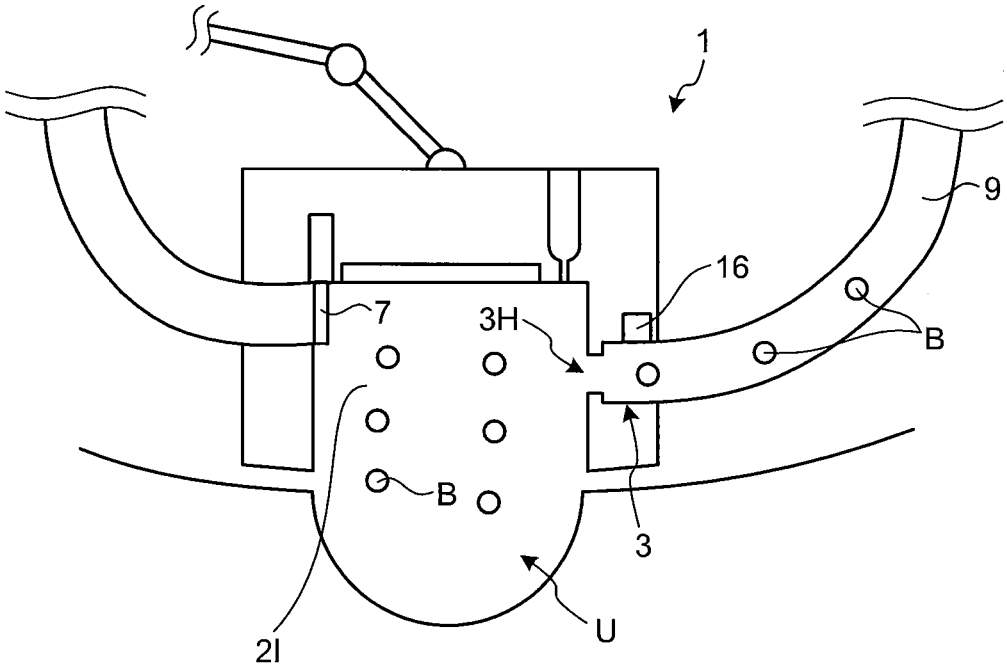
FIG. 5D is another illustrative schematic of the method of shot peening performed by using the shot peening apparatus according to the embodiment.

At Step S1, the movement controlling unit 21 included in the shot peening controller 20 shown in FIG. 1 operates the manipulator 32 to move the shot peening apparatus 1 attached to the tip of the manipulator 32 to the treated region U (FIG. 5C). The shot peening apparatus 1 is attached to the tip of the manipulator 32 instead of the electrical discharge machine 30 shown in FIG. 5A. At this time, the shot outlet shutter 7 in the storage container 2 in the shot peening apparatus 1 is closed, and no shot is in the container inside 2I.

At Step S2, the shot supply controlling unit 22 of the shot peening controller 20 shown in FIG. 1 drives the blower 11 shown in FIG. 1, and supplies the shots B into the container inside 2I in the shot peening apparatus 1 through the shot supplying passage 9. At this time, the shot supply controlling unit 22 obtains a signal from the shot counter 16 to count the number of the shots B supplied into the container inside 2I. This is because the shot peening needs to be performed by using a predetermined number of the shots B. The number of the shots B counted by the shot counter 16 is displayed on the display unit 17 shown in FIG. 1. The operator continues to supply the shots B until the predetermined number of the shots B is supplied in the container inside 2I, based on the number of the shots B displayed on the display unit 17.

Figure 5E:
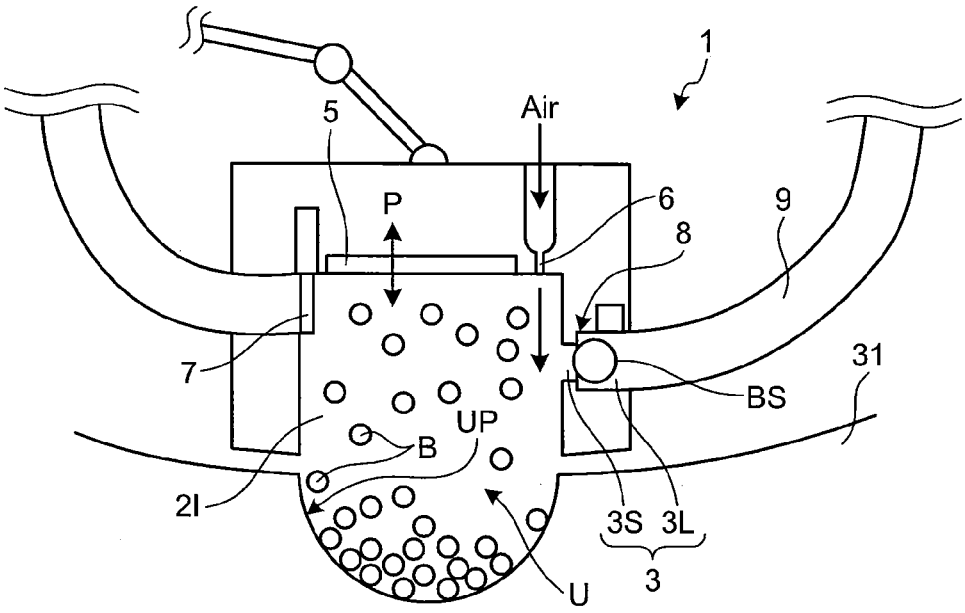
FIG. 5E is another illustrative schematic of the method of shot peening performed by using the shot peening apparatus according to the embodiment.

After the predetermined number of the shots B is supplied into the container inside 2I, the blocking object BS is supplied through the shot supplying passage 9. As shown in FIG. 5E, because the blocking object BS becomes locked at the connection between the inner-side inlet passage 3S and the outer-side inlet passage 3L, the shot inlet 3 is closed by way of the blocking object BS. At Step S3, in this condition, the operation controlling unit 23 included in the shot peening controller 20 shown in FIG. 1 performs shot peening. The operation controlling unit 23 drives the vibrator 5, and drives the pump 15 shown in FIG. 1 as well, to inject gas from the gas injecting nozzle 6 into the container inside 2I, to disperse the shots B in the container inside 2I. The vibrator 5 vibrates in the direction shown by an arrow P in FIG. 5E, to shoot out the shots B toward the treated region surface UP at the treated region U. The shots B impact on the treated region surface UP, and a compressive stress is applied thereto. During this operation, the shot outlet shutter 7 is closed, to prevent the shots B from leaking out of the container inside 2I.

Figure 5F:
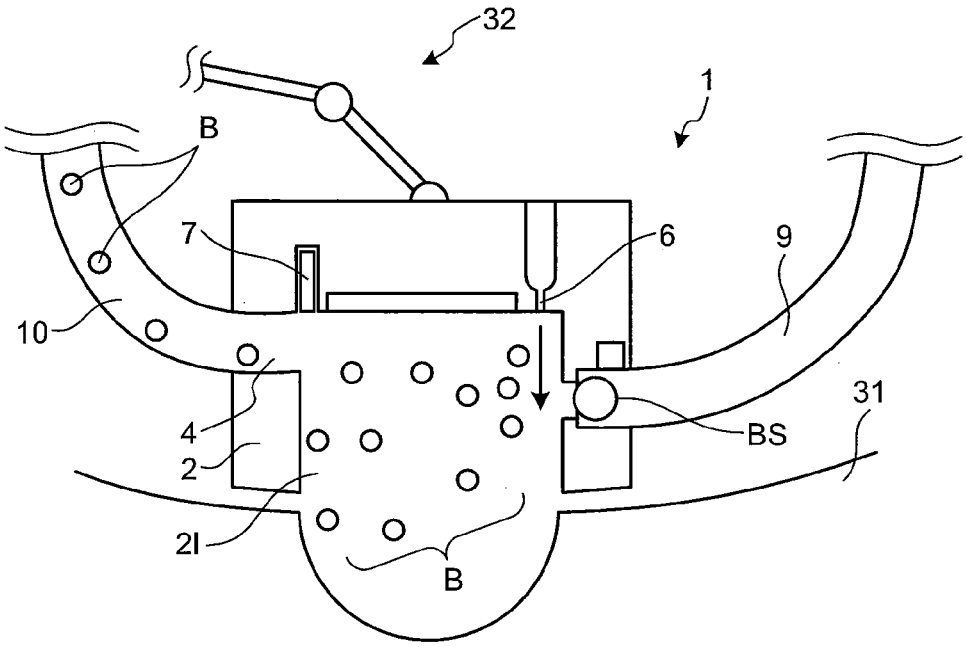
FIG. 5F is another illustrative schematic of the method of shot peening performed by using the shot peening apparatus according to the embodiment.

When the operation controlling unit 23 determines that the shot peening is performed over a predetermined period of time, the operation controlling unit 23 stops driving the vibrator 5 and the pump 15 shown in FIG. 1 to complete the shot peening. At Step S4, the shot collection controlling unit 24 included in the shot peening controller 20 shown in FIG. 1 opens the shot outlet shutter 7 as shown in FIG. 5F, and drives the suctioning unit 12 shown in FIG. 1 to collect the shots B from the container inside 2I through the shot outlet 4 and the shot collecting passage 10. At this time, the shot collection controlling unit 24 drives the pump 15 shown in FIG. 1 to inject gas from the gas injecting nozzle 6 into the container inside 2I to disperse the shots B in the container inside 2I, so that the shots B gather near the shot outlet 4.

The shots B that have passed thorough the shot collecting passage 10 are collected into the shot tray 14 shown in FIG. 1, and counted. The number of the shots B collected in the shot tray 14 may be counted by a shot counting unit such as a photoelectric cell or a magnetic sensor arranged at an entrance of the shot tray 14. In this manner, labors of counting the shots B will be alleviated. If the number of the shots B supplied into the container inside 2I of the shot peening apparatus 1 matches the number of shots B collected from the container inside 2I at Step S4, the movement controlling unit 21 shown in FIG. 1 moves the shot peening apparatus 1 away from the treated region U at Step S5.

Following the steps described above, the shot peening is completed by using the shot peening apparatus 1. In this manner, in the present embodiment, the shots B are supplied into the container inside 2I in the shot peening apparatus 1 as well as the number of the shots B is counted at the treated region U. Furthermore, in the present embodiment, the shots B are collected from the container inside 2I of the shot peening apparatus 1, and the number of the shots B is counted at the treated region U. If the number of the shots B supplied into the container inside 2I matches the number of the shots B collected from the container inside 2I, the shot peening apparatus 1 is moved away from the treated region U.

In this manner, shot peening can be performed reliably by using a predetermined number of the shots B. Furthermore, the number of the shots used in shot peening can be managed. Moreover, because the shots B are supplied into and collected from the container inside 2I of the shot peening apparatus 1 at the treated region U, the shots B can be prevented from being lost while moving the shot peening apparatus 1. Furthermore, in the present embodiment, because the shots B are collected from the container inside 2I in the shot peening apparatus 1 at the treated region U, all of the shots B used for the shot peening can be collected more reliably, in comparison with a method in which the container opening 2T in the storage container 2 is closed by a shutter, for example, to store the shots B in the container inside 2I, as shown in FIG. 1, after completing the shot peening.

Especially when the treated region U is a concave recessing toward the direction G that the gravity works as shown in FIG. 5B, the shots B could remain in the concave. However, according to the present embodiment, because the shots B are collected from the container inside 2I in the shot peening apparatus 1 at the treated region U, all of the shots B used for shot peening can be collected reliably. Especially, upon performing shot peening in a closed space, such as shot peeing the inner surface of the nozzle stub at an entrance and an exit of a steam generator used for a nuclear power plant, if the shots B leaks out of the container inside 2I, it will be extremely difficult to find the shots B in the complex piping of the plant. According to the present embodiment, because the shots B used for the shot peening can be collected reliably, the present invention is extremely effective for shot peening performed at such a location.

Figure 5G:
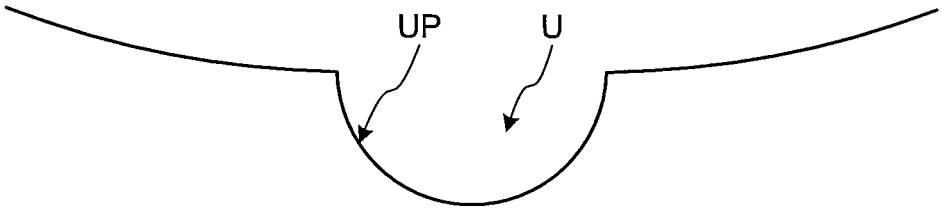
FIG. 5G is another illustrative schematic of the method of shot peening performed by using the shot peening apparatus according to the embodiment.
Figure 5H:
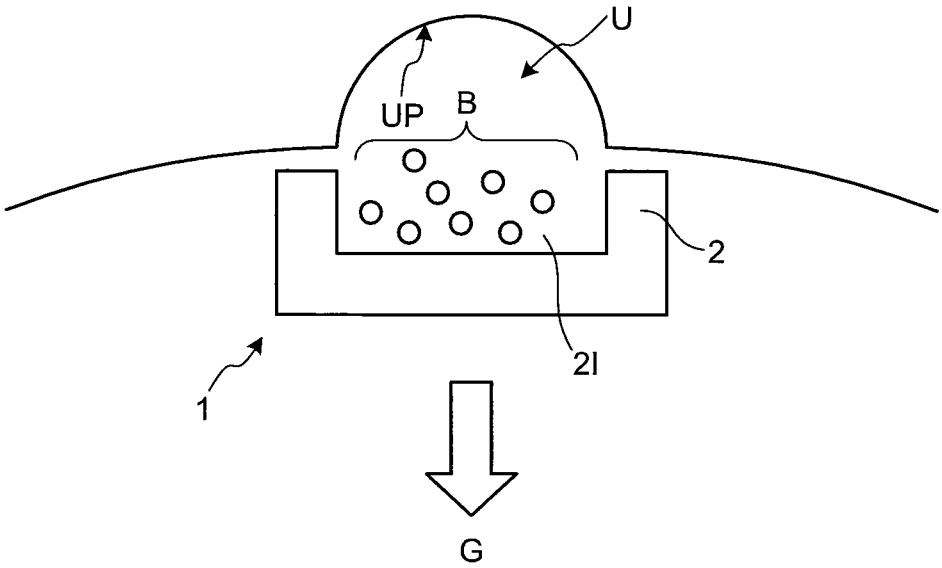
FIG. 5H is another illustrative schematic of the method of shot peening performed by using the shot peening apparatus according to the embodiment.

Following the steps described above, a compressive stress is applied to the treated region surface UP of the shot-peening treated region U as shown in FIG. 5G. In the steps described above, the treated region U is arranged toward the direction G that the gravity works, as shown in FIG. 5A; however, the shot peening can be performed by using the shot peening apparatus 1 even when the treated region U is arranged toward the opposite direction as the direction that the gravity works, as shown in FIG. 5H. Because the shots B are collected from the container inside 2I of the shot peening apparatus 1 at the treated region U in such a position as well, all of the shots B used for shot peening can be collected reliably. In this manner, according to the present embodiment, the shots can be collected reliably, regardless of a position or an arrangement of the shot-peening treated region.

INDUSTRIAL APPLICABILITY

As described above, the shot peening apparatus and the shot peening method according to the present invention is useful for reliably collecting shots for use in shot peening regardless of the position of a shot-peening treated region, and are especially suited for performing shot peening within a closed space.

The invention claimed is:

1. A shot peening apparatus for a power generating facility in a nuclear power plant comprising:

a storage container that stores therein shots impacting on a shot-peening treated region, the storage container including:

an opening configured to face the shot-peening treated region, the shot-peening treated region being in a sealed space in the power generation facility in the nuclear power plant;

a shot inlet through which the shots are supplied to inside the storage container;

a shot outlet arranged separately from the shot inlet and through which the shots inside the storage container are taken out from the storage container; and a shot accelerating unit that accelerates the shots in the storage container and is arranged on the bottom of the storage container separately from the shot inlet;

a shot supplying passage connected to the shot inlet, and through which the shots are supplied to inside the storage container;

a shot collecting passage connected to the shot outlet, and through which the shots inside the storage container are collected from inside the storage container by way of sucking;

a shot counting until that is arranged at either one of the shot inlet and the shot supplying passage and counts number of the shots to be supplied to inside the storage container; and a movement controlling unit that moves the shot-peening apparatus away from the shot-peening treated region when the number of the shots supplied to the inside of the storage container matches the number of the shots collected from the inside of the storage container, wherein the shot accelerating unit is a vibrator.

2. The shot peening apparatus according to claim 1, further comprising a shot outlet opening and closing unit that opens and closes the shot outlet.

3. The shot peening apparatus according to claim 1, further comprising a shot inlet opening and closing unit that opens and closes the shot inlet.

4. The shot peening apparatus according to claim 1, wherein the shot inlet is blocked with a blocking object that blocks the shot inlet, while shot peening is being performed, and the shot inlet is formed to have a smaller cross section on an inner side of the storage container than on an outer side of the storage container, and the shot inlet on the inner side of the storage container allows the shots, but not the blocking object, to pass therethrough.

5. A method of shot peening comprising:

moving a shot peening apparatus to a shot-peening treated region which is in a sealed space in the power generating facility in the nuclear power plant, the shot peening apparatus including a storage container that stores therein shots impacting on the shot-peening treated region and that includes an opening configured to face the shot-peening treated region, a shot inlet through which the shots are supplied to inside the storage container, a shot outlet arranged separately from the shot inlet and through which the shots inside the storage container are taken out from the storage container, and a shot accelerating unit that accelerates the shots in the storage container and is arranged on the bottom of the storage container separately from the shot inlet, the shot accelerating unit being a vibrator, and a shot collecting passage that is connected to the shot outlet and through which the shots are collected from inside the storage container, and a shot supplying passage that is connected to the storage container and through which the shots are supplied to inside the storage container, a shot counting unit that is arranged at either one of the shot inlet and the shot supplying passage, and a movement controlling unit that moves the shot-peening apparatus;

supplying the shots for use in shot peening from the shot supplying passage to inside the storage container;

counting number of the shots to be supplied to inside the storage container;

storing the shots in the storage container;

accelerating the shots in the storage container toward the opening;

shot peening;

collecting the shots by sucking the shots from inside the storage container through the shot collecting passage at the shot-peening treated region, after the step of shot peening is completed; and moving the shot peening apparatus away from the treated region when the number of the shots supplied to the inside of the storage container matches the number of the shots collected from the inside of the storage container.

* * * * *